US010246960B2

(12) United States Patent
Shepler et al.

(10) Patent No.: US 10,246,960 B2
(45) Date of Patent: Apr. 2, 2019

(54) ELECTRIC SUBMERSIBLE PUMP CABLE ANCHORED IN COILED TUBING

(71) Applicant: Saudi Arabian Oil Company, Dhahran (SA)

(72) Inventors: Randall Shepler, Ras Tanura (SA); Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 225 days.

(21) Appl. No.: 15/335,708

(22) Filed: Oct. 27, 2016

(65) Prior Publication Data

US 2017/0328156 A1 Nov. 16, 2017

Related U.S. Application Data

(60) Provisional application No. 62/334,026, filed on May 10, 2016.

(51) Int. Cl.

| | |
|---|---|
| ***E21B 23/01*** | (2006.01) |
| ***E21B 17/20*** | (2006.01) |
| *E21B 43/12* | (2006.01) |

(52) U.S. Cl.

CPC ..... *E21B 23/01* (2013.01); *E21B 17/206* (2013.01); *E21B 17/20* (2013.01); *E21B 43/128* (2013.01)

(58) Field of Classification Search

CPC ..... E21B 23/01; E21B 17/206; E21B 17/003; E21B 43/128; E21B 17/20

See application file for complete search history.

(56) References Cited

U.S. PATENT DOCUMENTS

| | | | |
|---|---|---|---|
| 4,515,213 | A | 5/1985 | Rogen et al. |
| 5,269,377 | A | 12/1993 | Martin |
| 5,435,351 | A | 7/1995 | Head |
| 5,821,452 | A | 10/1998 | Neuroth et al. |
| 5,988,286 | A | 11/1999 | Dwiggins |
| 5,992,468 | A | 11/1999 | Dwiggins |
| 5,996,689 | A | 12/1999 | Head |
| 6,143,988 | A | 11/2000 | Neuroth et al. |
| 6,167,915 | B1 | 1/2001 | Collie et al. |
| 7,273,109 | B2 | 9/2007 | Moore et al. |
| 7,670,451 | B2 | 3/2010 | Head |
| 7,849,928 | B2 | 12/2010 | Collie |
| 7,905,295 | B2 | 3/2011 | Mack |

(Continued)

OTHER PUBLICATIONS

The International Search Report and Written Opinion for related PCT application PCT/US2017/031889 dated Sep. 7, 2017.

*Primary Examiner* — Michael R Wills, III

(74) *Attorney, Agent, or Firm* — Bracewell LLP; Constance G. Rhebergen; Linda L. Morgan

(57) ABSTRACT

A system for deploying a power cable within a coiled tubing includes a power cable operable to power an electrical submersible pump, the power cable extendable through a coiled tubing. A plurality of anchor assemblies are spaced along a length of the power cable, each of the anchor assemblies secured to the power cable and having a gripping element. The gripping element is moveable between a retracted position and an extended position in response to an applied stimuli, wherein the gripping element is sized to engage an inner diameter surface of the coiled tubing when the gripping element is in the extended position.

18 Claims, 3 Drawing Sheets

(56) References Cited

U.S. PATENT DOCUMENTS

| | | | | |
|---|---|---|---|---|
| 8,272,448 | B2 * | 9/2012 | Mack | E21B 17/206 138/112 |
| 8,931,549 | B2 | 1/2015 | Smith | |
| 8,985,226 | B2 | 3/2015 | Head | |
| 9,074,592 | B2 | 7/2015 | Morrison et al. | |
| 9,255,457 | B2 | 2/2016 | Scarsdale et al. | |
| 9,281,675 | B2 | 3/2016 | Cox | |
| 2005/0045343 | A1 | 3/2005 | Bixenman et al. | |
| 2008/0264651 | A1 | 10/2008 | Ali et al. | |
| 2009/0308590 | A1 * | 12/2009 | Xu | E21B 31/18 166/99 |
| 2010/0096144 | A1 | 4/2010 | Mack | |
| 2012/0273236 | A1 * | 11/2012 | Gandikota | E21B 43/103 166/382 |
| 2013/0272906 | A1 | 10/2013 | Head | |
| 2014/0190706 | A1 | 7/2014 | Varkey et al. | |
| 2014/0367106 | A1 | 12/2014 | Wells et al. | |
| 2016/0115759 | A1 | 4/2016 | Richards et al. | |

* cited by examiner

ELECTRIC SUBMERSIBLE PUMP CABLE ANCHORED IN COILED TUBING

CROSS REFERENCE TO RELATED APPLICATION

This application claims priority to and the benefit of U.S. Provisional Application Ser. No. 62/334,026, filed May 10, 2016, titled "Electric Submersible Pump Cable Anchored In Coiled Tubing," the full disclosure of which is hereby incorporated herein by reference in its entirety for all purposes.

BACKGROUND OF THE DISCLOSURE

1. Field of the Disclosure

The disclosure relates generally to electric submersible pump cables, and more particularly to rig-less deployment of electrical submersible pumps having cables within coiled tubing.

2. Description of the Related Art

Electrical submersible pumping ("ESP") systems are deployed in some hydrocarbon producing wellbores to provide artificial lift to deliver fluids to the surface. The fluids, which typically are liquids, are made up of liquid hydrocarbon and water. When installed, a typical ESP system is suspended in the wellbore at the bottom of a string of production tubing. In addition to a pump, ESP systems usually include an electrically powered motor and seal section. The pumps are often one of a centrifugal pump or positive displacement pump.

When the ESP fails, workover rigs are used to pull out the tubing and replace the failed ESP. Workover rigs are costly, especially offshore. Also, waiting time for rigs can be as long as 6-12 months, leading to significant production deferral.

Technologies are being developed to allow for rig-less deployment of ESPs inside the production tubing with the power cable. When an ESP fails, coiled tubing or a wireline unit can be used to pull out and replace the failed ESP, leaving production tubing in place. In some rig-less ESP systems, the power cable must have sufficient mechanical strength to carry the weight of the cable itself as well as the ESP system, and also have the strength to handle the pull forces for system retrieval. The power cable must also be able to withstand erosion and corrosion since it is operated in the production fluids which contain H2S, CO2 and water with high concentration of chloride. In order to provide sufficient current to drive the motor of the ESP, the conductor of the power cable can be as large as AWG#2. However, the power cable needs to be as compact in size as possible. Production fluids are produced in the annulus between the production tubing inside diameter and the power cable outside diameter. A large diameter power cable that has sufficient strength for supporting and removing the ESP will reduce the flow area, increase friction and will therefore increase the size of the motor required to lift the fluids to surface.

SUMMARY OF THE DISCLOSURE

Embodiments disclosed herein describe systems and methods for anchoring an ESP power cable inside coiled tubing so that the power cable is supported and is and protected from corrosive environments by the coiled tubing.

Systems and methods of this disclosure use materials that can undergo volume or shape change under stimuli to anchor the power cable inside the coiled tubing.

In an embodiment of this disclosure a system for deploying a power cable within a coiled tubing includes a power cable operable to power an electrical submersible pump, the power cable extendable through a coiled tubing. A plurality of anchor assemblies are spaced along a length of the power cable, each of the anchor assemblies secured to the power cable and having a gripping element. The gripping element is moveable between a retracted position and an extended position in response to an applied stimuli, wherein the gripping element is sized to engage an inner diameter surface of the coiled tubing when the gripping element is in the extended position.

In alternate embodiments, the anchor assembly can include a split collar that circumscribes the power cable, securing the anchor assembly to the power cable. Alternately, the anchor assembly can be bonded directly to the power cable, securing the anchor assembly to the power cable. The gripping element can include a swellable elastomer and the applied stimuli can be a dielectric oil. The swellable elastomer can be bonded to a split collar that circumscribes the power cable, securing the anchor assembly to the power cable.

In other alternate embodiments, the gripping element can include a shape memory polymer and the applied stimuli can be a temperature change, an electric field, a magnetic field, or light. Alternately, the gripping element can include two way shape memory effect material and the applied stimuli can be a temperature change.

In yet other alternate embodiments, the anchor assembly can have an actuator, the actuator operable to move the gripping element between the retracted position and the extended position in response to the applied stimuli. The actuator can be formed of a shape memory alloy and the applied stimuli can be a temperature change, an electric field, a magnetic field, or light. The actuator can be oriented to expand and contract in a direction along an axis of the power cable to move the gripping element radially between the retracted position and the extended position.

In another embodiment of this disclosure, a system for providing power to an electric submersible pump includes a coiled tubing extending within a subterranean well. A power cable is located within the coiled tubing. A plurality of anchor assemblies are spaced along a length of the power cable, each of the anchor assemblies secured to the power cable with a split collar and having a gripping element. The gripping element is secured to the split collar. The gripping element is moveable between a retracted position and an extended position in response to an applied stimuli, wherein the gripping element is sized to engage an inner diameter surface of the coiled tubing when the gripping element is in the extended position and to have a reduced outer diameter when the gripping element is in the retracted position.

In alternate embodiments, the gripping element can include a swellable elastomer and the applied stimuli is a dielectric oil. The gripping element can include a shape memory polymer and the applied stimuli can be a temperature change, an electric field, a magnetic field, or light. The gripping element can alternately include two way shape memory effect material and the applied stimuli can be a temperature change.

In other alternate embodiments, the anchor assembly can have an actuator that includes a shape memory alloy, the actuator operable to move the gripping element between the retracted position and the extended position in response to the applied stimuli, wherein the applied stimuli can be a temperature change, an electric field, a magnetic field, or light. The actuator can be oriented to expand and contract in a direction along an axis of the power cable to move the gripping element radially between the retracted position and the extended position.

In yet another alternate embodiment of the current disclosure, a method for deploying a power cable within a coiled tubing includes providing a power cable with a plurality of anchor assemblies spaced along a length of the power cable, each of the anchor assemblies secured to the power cable and having a gripping element, wherein the power cable is operable to power an electrical submersible pump. The power cable is extended through a coiled tubing. A stimuli can be applied to the anchor assembly to move the gripping element from a retracted position to an extended position, so that the gripping element engages an inner diameter surface of the coiled tubing.

In alternate embodiments, providing the power cable with the plurality of anchor assemblies can include securing the anchor assembly to the power cable with a split collar that circumscribes the power cable. The gripping element can include a swellable elastomer and applying the stimuli to the anchor assembly can include pumping a dielectric oil into the coiled tubing. Alternately, the gripping element can include a shape memory polymer and the step of applying the stimuli to the anchor assembly can include providing a temperature change, providing an electric field, providing a magnetic field, or providing a light.

In other alternate embodiments, the anchor assembly can have an actuator that includes a shape memory alloy, and applying the stimuli to the anchor assembly can include applying the stimuli to the actuator to move the gripping element between the retracted position and the extended position in response to an applied stimuli. The actuator can be oriented so that applying the stimuli to the anchor assembly expands and contracts the actuator in a direction along an axis of the power cable to move the gripping element radially between the retracted position and the extended position.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
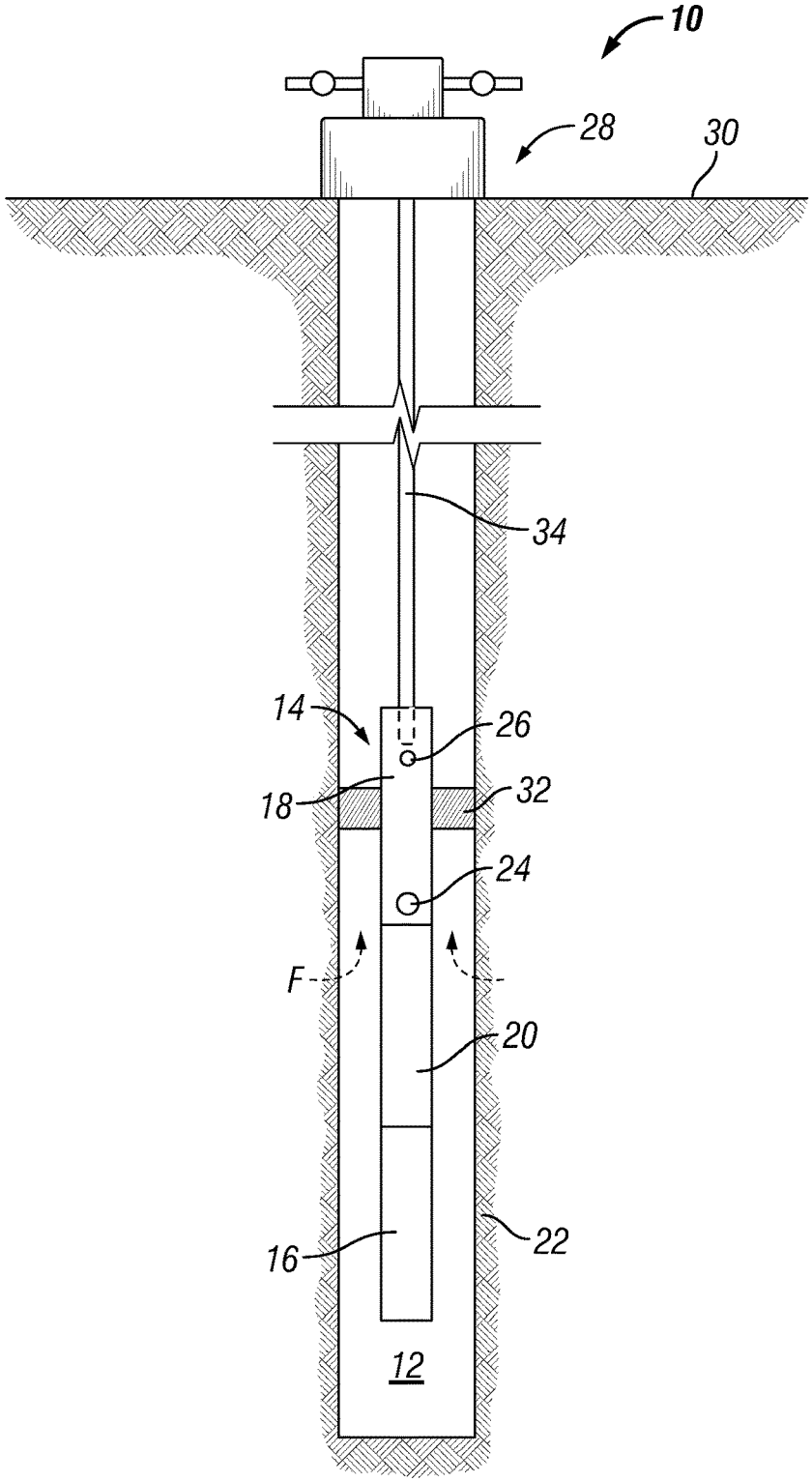
FIG. 1 is a schematic section view of a subterranean well with an ESP and coiled tubing, in accordance with an embodiment of this disclosure.

Looking at FIG. 1, subterranean well 10 includes wellbore 12. ESP 14 is located within wellbore 12 The ESP of FIG. 1 includes a motor 16 on its lowermost end which is used to drive a pump 18 at an upper portion of ESP 14. Between motor 16 and pump 18 is seal section 20 for equalizing pressure within ESP 14 with that of wellbore 12. Fluid F is shown entering wellbore 12 from a formation 22 adjacent wellbore 12. Fluid F flows to inlet 24 formed in the housing of pump 18. Fluid F is pressurized within pump 18 and exits out of ESP 14 at outlet 26 and into wellbore 12 or a production string (not shown). Fluids would then travel up to wellhead 28 at surface 30. Packer 32 can seal around ESP 14 between inlet 24 and outlet 26.

ESP 14 is suspended within wellbore 12 with coiled tubing 34. Looking at FIG. 2, coiled tubing 34 is an elongated tubular member with central bore 36 that has inner diameter surface 38. Coiled tubing 34 extends within subterranean well 10. Coiled tubing 34 can be formed of carbon steel material, carbon fiber tube, or other types of corrosion resistance alloys or coatings.

Power cable 40 extends through coiled tubing 34. Power cable 40 can provide the power required to operate ESP 14. Power cable 40 can be a suitable power cable for powering an ESP, known to those with skill in the art. Power cable 40 can be an existing cable that is readily available in the market.

Anchor assemblies 42 can be spaced along a length of power cable 40. Each of the anchor assemblies 42 are secured to power cable 40. The number of anchor assemblies 42 and the spacing between anchor assemblies 42 can be selected so that there are sufficient anchor assemblies 42 to support the weight of power cable 40 within coiled tubing 34, including an industry standard safety factor. As an example, some current ESP power cables weigh about 1 lbm/ft. For such a cable, anchor assemblies 42 can be spaced, for example every 50-200 ft along power cable 40, and in certain embodiments, anchor assemblies 42 can be located every 100 ft along power cable 40.

Figure 2:
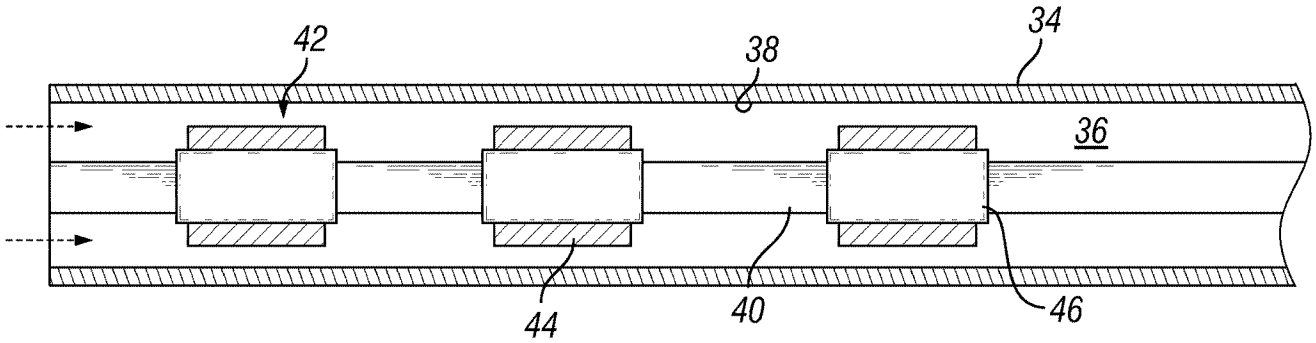
FIG. 2 is a schematic section view of a power cable within a coiled tubing, in accordance with an embodiment of this disclosure, shown with the gripping elements in the retracted position.
Figure 3:
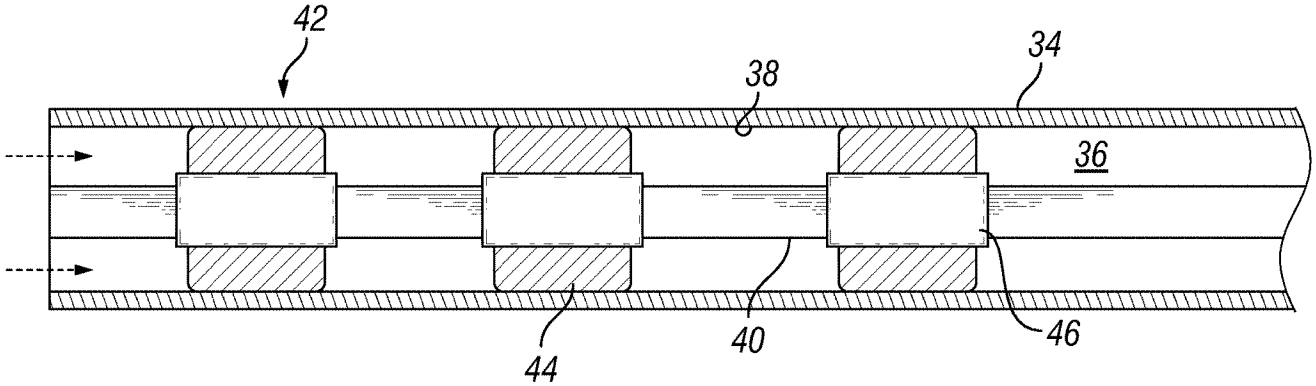
FIG. 3 is a schematic section view of the power cable within the coiled tubing of FIG. 2, shown with the gripping elements in the extended position.

Looking at FIGS. 2-3, anchor assemblies 42 include gripping element 44. Gripping element 44 is moveable between a retracted position (FIG. 2) and an extended position (FIG. 3) in response to an applied stimuli. Gripping element 44 is sized so that when in the extended position, gripping element 44 engages inner diameter surface 38 to provide anchoring and support for power cable 40. When gripping element 44 is in the extended position, power cable 40 at the location of gripping element 44 is axially static relative to coiled tubing 34

When gripping element 44 is in the retracted position, gripping element 44 can have a reduced outer diameter so that gripping element 44 is spaced apart from inner diameter surface 38. In this way, when gripping element 44 is in the retracted position, power cable 40 can move within coiled tubing 34. When gripping element 44 is in the retracted position, with anchor assemblies 42 secured to power cable 40, power cable 40 can be drawn or hydraulic pressured through coiled tubing 34. When gripping element 44 is in the retracted position, with anchor assemblies 42 secured to power cable 40, power cable 40 can also be withdrawn from coiled tubing 34.

Gripping element 44 is secured to power cable 40 with connection member 46 that allows gripping element 44 to be secured around power cable 40 without having to slide the connection means along power cable 40 from an end of power cable 40, but instead can be added at any position along the length of power cable 40. Gripping element 44 can be secured to the connection member 46 so that gripping element 44 is secured to power cable 40 by way of connection member. The use of connection member 46 allows for an operator to utilize a standard and readily available cost effective power cable 40.

As an example, anchor assembly 42 can include connection member 46 that is a split collar. The split collar can include two or more segments that are secured together around power cable 40. The split collar can circumscribe power cable 40, securing anchor assembly 42 to power cable 40. Gripping element 44 can be secured to the split collar so that gripping element 44 is secured to power cable 40 by way of the split collar. In alternate embodiments, connection member 46 can be a bonding material and anchor assembly 42 can be directly bonded to power cable 40 by way of the bonding material.

Anchor assembly 42 can be formed, in part, of materials that can undergo volume or shape change under stimuli, such as a shape memory material. Looking at the example embodiment of FIGS. 2-3, gripping element 44 can include a swellable elastomer. The swellable elastomer can change shape to cause gripping element 44 to move between the retracted position (FIG. 2) and the extended position (FIG. 3). The swellable elastomer can, for example, be bonded to a connection member 46 that is a split collar, or alternately connection member 46 can be a bonding material so that the swellable elastomer is directly bonded to power cable 40.

The swellable elastomer can be, for example, an elastomer that swells with an applied stimuli that is a hydrocarbon based fluid. The hydrocarbon based fluid can be pumped into coiled tubing 34. The elastomer absorbs the hydrocarbon based fluid, such as a dielectric oil, swells in volume, and expands radially to create a friction against the inner diameter surface 38 of coiled tubing 34, allowing power cable 40 to be anchored inside coiled tubing 34. The hydrocarbon based fluid is absorbed into the swellable elastomer through diffusion. The amount of swell of is dependent on the chemistry of the elastomer and the hydrocarbon based fluid. Design changes can be made to the parameters of the swellable elastomer, such as the length of the swellable elastomer, to achieve a desired anchoring force across the anchor assembly 42.

Figure 4:
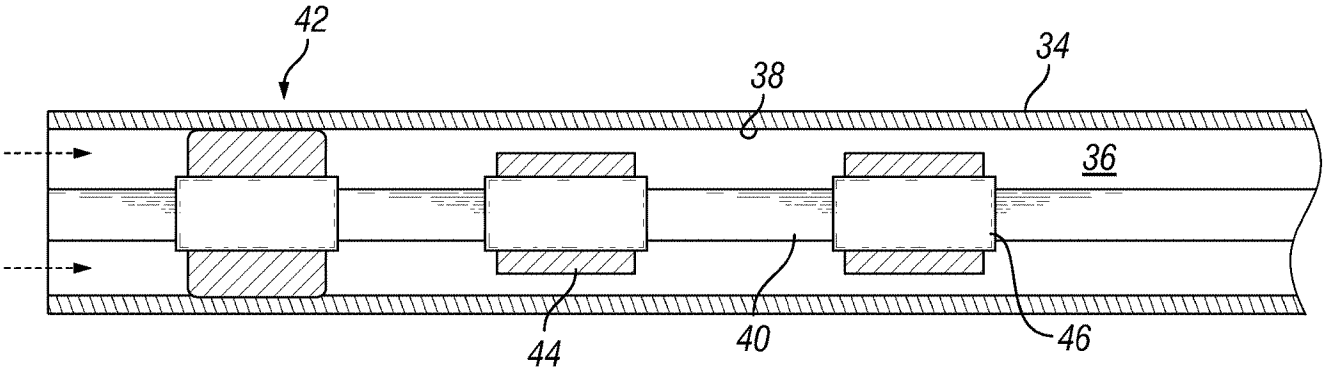
FIG. 4 is a schematic section view of a power cable within a coiled tubing, in accordance with an embodiment of this disclosure, shown with one of the gripping elements in the extended position and the other gripping elements in the retracted position.

In alternate embodiments gripping element 44 can include a shape memory polymer. Looking at FIG. 4, the shape memory polymer can, for example, be bonded to a connection member 46 that is a split collar, or alternately connection member 46 can be a bonding material so that the shape memory polymer is directly bonded to power cable 40. After power cable 40 has been installed within coiled tubing 34, spacing measurement or detection means can be used to determine the locations of the shape memory material segments within coiled tubing 34. The detection means can include electric-magnetic, acoustic or other techniques. Stimuli such as a temperature change, electric field, electric-magnetic field, light, or others known in the art, can be applied to the shape memory polymer from outside of coiled tubing 34. The applied stimuli can cause the shape memory polymer to expand and support power cable 40 against inner diameter surface 38 of coiled tubing 34, providing anchoring and support to power cable 40.

In an example embodiment, the shape memory polymer can be a two way shape memory effect material that has the ability to return from a deformed state (temporary shape) to an original (permanent) shape induced by the external stimulus or trigger. As an example, the shape memory polymer can change between rigid and elastic states by way of thermal stimuli. The change takes place at what is termed as the glass transition temperature (Tg). At a temperature above Tg, the material can be deformed. The deformed shape will be maintained when the material is cooled below Tg. The material will "remember" or return to its original shape when it is heated to a temperature above Tg again. The glass transition temperature can be custom-engineered according to specific applications.

The gripping element 44 having shape memory polymer can therefore be secured to power cable 40 in a deformed shape, in which the shape memory polymer has been deformed at a temperature above Tg so that gripping element 44 is in a retracted position, and then cooled with gripping element 44 remaining in the retracted position. After power cable 40 is drawn or pressured through coiled tubing 34, gripping element 44 can be heated to a temperature above Tg so that the shape memory polymer returns to its original shape and gripping element 44 is moved to the extended position to anchor and support power cable 40 inside coiled tubing 34 (leftmost anchor assembly of FIG. 4). In securing power cable 40 within coiled tubing 34, in the embodiments of FIGS. 2-4, only gripping element 44 undergoes radial movement. Systems described herein therefore have minimal moving parts, which maximizes the reliability of such systems.

In order to remove power cable 40 from coiled tubing 34 for repair or replacement, the two-way shape memory polymer in the extended position can be cooled down to a retracted position. Power cable 40 can then be removed from coiled tubing 34 while gripping elements 44 are in the retracted position. Due to the two-way nature of the shape memory polymer, the removal process is straight forward. By cooling the shape memory polymer, gripping element 44 can be moved to the retracted position so that gripping element 44 is spaced apart from inner diameter surface 38 and power cable 40 can be drawn out of coiled tubing 34. The two-way memory effect material advantageously can repeatedly engage and disengage inner diameter surface 38, as desired, in order to set, remove, and reset power cable 40 within coiled tubing 34 without damaging power cable 40.

Figure 5:
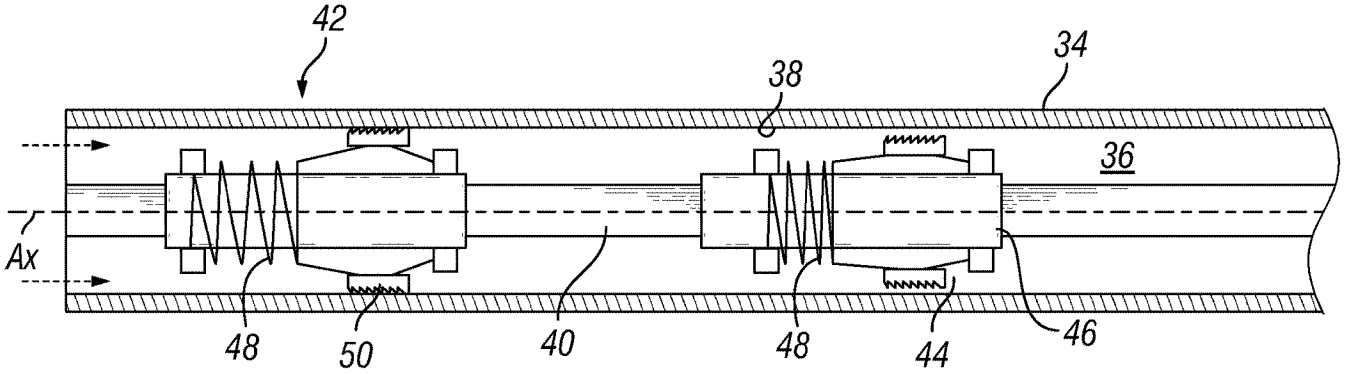
FIG. 5 is a schematic section view of a power cable within a coiled tubing, in accordance with an embodiment of this disclosure, shown with one of the gripping elements in the extended position and the other gripping element in the retracted position.

Looking at FIG. 5, in an alternate embodiment, anchor assembly 42 can include actuator 48. Actuator 48 can include a shape memory material, such as a shape memory alloy. Actuator 48 can move the gripping element 44 between the retracted position and the extended position in response to an applied stimuli. The applied stimuli can be, for example, a temperature change, an electric field, a magnetic field, light, or other common stimuli. In the example of FIG. 5, actuator 48 expands and contracts in a direction along axis Ax of power cable 40. As actuator 48 expands and contracts in a direction along axis Ax of power cable 40, gripping element 44 moves radially between the retracted position and the extended position.

In the example of FIG. 5, actuator 48 is a spring shaped member. In the anchor assembly 42 shown on the right hand side of FIG. 5, actuator 48 is contracted and gripping element 44 is in the retracted position. Gripping element 44 includes slips 50 that have gripping elements, such as teeth, that can anchor and secure power cable 40 within coiled tubing 34. When gripping element 44 is in the retracted position, slips 50 are spaced apart from inner diameter surface 38. In the anchor assembly 42 shown on the left hand side of FIG. 5, actuator 48 is expanded and gripping element 44 is in the extended position. When gripping element 44 is in the extended position, slips 50 are engaged with inner diameter surface 38, anchoring and supporting power cable 40 within coiled tubing 34. In the example of FIG. 5, gripping element 44 undergoes radial movement and actuator 48 undergoes axial movement.

Actuator 48 can include two-way memory effect material so that gripping element 44 can be moved between the extended and retracted positions and slips 50 can engage and then disengage inner diameter surface 38 so that power cable 40 can be withdrawn from coiled tubing 34 for repair or replacement. The two-way memory effect material can be reversed by an applied stimuli such as, for example, a temperature change, an electric field, a magnetic field, light, or other common or known stimuli, so that gripping element 44 can be moved to the retracted position so that gripping element 44 is spaced apart from inner diameter surface 38 and power cable 40 can be drawn out of coiled tubing 34.

In an example of operation, to deploy power cable 40 within coiled tubing 34 so that ESP 14 can be installed and serviced in a rig-less operation, gripping elements 44 can be secured along a length of power cable 40. Power cable 40 can be drawn or pressured through coiled tubing 34. A stimuli can then be applied to gripping element 44 so that gripping element 44 moves from a retracted position to an extended position and engages inner diameter surface 38 of coiled tubing 34. Gripping element 44 can anchor and support power cable 40 within coiled tubing 34. If power cable 40 is to be removed, gripping element 44 can be moved to the retracted position so that gripping element 44 is spaced apart from inner diameter surface 38 and power cable 40 can be drawn out of coiled tubing 34.

Embodiments of this disclosure therefore provide for the encapsulation of power cable 40 within coiled tubing 34, allowing for rig-less deployment of ESP 14. Coiled tubing 34 provides mechanical strength as well as physical and corrosion protection for power cable 40, which can be used to transmit electricity from surface 30 to drive motor 16 of ESP 14.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for deploying a power cable within a coiled tubing, the system comprising:

a power cable operable to power an electrical submersible pump, the power cable extendable through a coiled tubing;

a plurality of anchor assemblies spaced along a length of the power cable, each of the anchor assemblies secured to the power cable and having a gripping element; wherein the gripping element is moveable between a retracted position and an extended position in response to an applied stimuli applied to the gripping element, wherein the gripping element is sized to engage an inner diameter surface of the coiled tubing when the gripping element is in the extended position; and the gripping element includes a two way shape memory effect material.

2. The system of claim 1, wherein the anchor assembly includes a split collar that circumscribes the power cable, securing the anchor assembly to the power cable.

3. The system of claim 1, wherein the anchor assembly is bonded directly to the power cable, securing the anchor assembly to the power cable.

4. The system of claim 1, wherein the two way shape memory effect material is a shape memory polymer and the applied stimuli is selected from a group consisting of a temperature change, an electric field, a magnetic field, and light.

5. The system of claim 1, wherein the applied stimuli is a temperature change.

6. The system of claim 1, wherein the anchor assembly has an actuator, the actuator operable to move the gripping element between the retracted position and the extended position in response to the applied stimuli.

7. The system of claim 6, wherein the actuator is formed of the two way shape memory material, the two way shape memory material being a shape memory alloy, and the applied stimuli is selected from a group consisting of a temperature change, an electric field, a magnetic field, and light.

8. The system of claim 6, wherein the actuator is oriented to expand and contract in a direction along an axis of the power cable to move the gripping element radially between the retracted position and the extended position.

9. A system for providing power to an electric submersible pump, the system comprising:

a coiled tubing extending within a subterranean well;

a power cable located within the coiled tubing;

a plurality of anchor assemblies spaced along a length of the power cable, each of the anchor assemblies secured to the power cable with a split collar and having a gripping element; wherein the gripping element is secured to the split collar;

the gripping element is moveable between a retracted position and an extended position in response to an applied stimuli applied to the gripping element, wherein the gripping element is sized to engage an inner diameter surface of the coiled tubing when the gripping element is in the extended position and to have a reduced outer diameter when the gripping element is in the retracted position; and the gripping element includes two way shape memory effect material.

10. The system of claim 9, wherein the two way shape memory effect material is a shape memory polymer and the applied stimuli is selected from a group consisting of a temperature change, an electric field, a magnetic field, and light.

11. The system of claim 9, wherein the applied stimuli is a temperature change.

12. The system of claim 9, wherein the anchor assembly has an actuator that includes the two way shape memory effect material and the two way shape memory effect material is a shape memory-alloy, the actuator operable to move the gripping element between the retracted position and the extended position in response to the applied stimuli, wherein the applied stimuli is selected from a group consisting of a temperature change, an electric field, a magnetic field, and light.

13. The system of claim 12, wherein the actuator is oriented to expand and contract in a direction along an axis of the power cable to move the gripping element radially between the retracted position and the extended position.

14. A method for deploying a power cable within a coiled tubing, the method comprising:

providing a power cable with a plurality of anchor assemblies spaced along a length of the power cable, each of the anchor assemblies secured to the power cable and having a gripping element that includes a two way shape memory effect material, wherein the power cable is operable to power an electrical submersible pump;

extending the power cable through a coiled tubing;

applying a stimuli to the two way shape memory effect material to move the gripping element radially outward from a retracted position to an extended position, so that the gripping element engages an inner diameter surface of the coiled tubing.

15. The method of claim 14, wherein providing the power cable with the plurality of anchor assemblies includes securing the anchor assembly to the power cable with a split collar that circumscribes the power cable.

16. The method of claim 14, wherein the two way shape memory effect material is a shape memory polymer and the step of applying the stimuli to the two way shape memory effect material includes is selected from a group consisting of a providing a temperature change, providing an electric field, providing a magnetic field, and providing a light.

17. The method of claim 14, wherein the anchor assembly has an actuator that includes the two way shape memory effect material is a shape memory alloy, and applying the stimuli to the two way shape memory effect material includes applying the stimuli to the actuator to move the gripping element between the retracted position and the extended position in response to the applied stimuli.

18. The method of claim 17, further comprising orienting the actuator so that applying the stimuli to the two way shape memory effect material expands and contracts the actuator in a direction along an axis of the power cable to move the gripping element radially between the retracted position and the extended position.

* * * * *